US009136631B2

(12) United States Patent
Naito

(10) Patent No.: US 9,136,631 B2
(45) Date of Patent: Sep. 15, 2015

(54) CONNECTOR AND FORMING METHOD THEREOF

(71) Applicant: JAPAN AVIATION ELECTRONICS INDUSTRY, LIMITED, Shibuya-ku, Tokyo (JP)

(72) Inventor: Takeharu Naito, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 74 days.

(21) Appl. No.: 13/913,051

(22) Filed: Jun. 7, 2013

(65) Prior Publication Data

US 2013/0330972 A1 Dec. 12, 2013

(30) Foreign Application Priority Data

Jun. 12, 2012 (JP) ..... 2012-133228

(51) Int. Cl.

| | |
|---|---|
| ***H01R 12/00*** | (2006.01) |
| ***H01R 13/40*** | (2006.01) |
| ***H01R 43/16*** | (2006.01) |
| ***H01R 12/72*** | (2011.01) |

(52) U.S. Cl.

CPC ..... *H01R 13/40* (2013.01); *H01R 12/724* (2013.01); *H01R 43/16* (2013.01); *Y10T 29/49218* (2015.01)

(58) Field of Classification Search

CPC ..... H01R 23/7073; H01R 43/24; H01R 13/65802; H01R 23/6873; H01R 13/658; H01R 23/025

USPC ..... 439/79, 606, 607.01, 607.35, 607.4, 439/607.44, 607.55, 660, 676

See application file for complete search history.

(56) References Cited

U.S. PATENT DOCUMENTS

| | | | | |
|---|---|---|---|---|
| 5,591,036 | A * | 1/1997 | Doi et al. | 439/79 |
| 6,022,227 | A * | 2/2000 | Huang | 439/79 |
| 6,447,307 | B1 * | 9/2002 | Wu | 439/79 |

(Continued)

FOREIGN PATENT DOCUMENTS

| | | | |
|---|---|---|---|
| JP | 2544977 | B2 | 10/1996 |
| JP | 2008-311227 | A | 12/2008 |

OTHER PUBLICATIONS

Korean Office Action dated Mar. 18, 2014 (and English translation thereof) issued in counterpart Korean Application No. 10-2013-0064420.

(Continued)

*Primary Examiner* — Thanh Tam Le

(74) *Attorney, Agent, or Firm* — Holtz, Holtz, Goodman & Chick PC

(57) ABSTRACT

A connector comprises a first contact, a housing and an arrangement member other than the housing. The first contact has a contact portion and a terminal portion. The housing holds the contact portion of the first contact so that the contact portion extends along a first direction. The housing is provided with an engaged portion. The arrangement member holds the terminal portion of the first contact so that the terminal portion extends along a second direction intersecting the first direction. The arrangement member is provided with an engaging portion. The engaging portion engages the engaged portion in a direction intersecting the second direction so that the arrangement member is held by the housing and the terminal portion of the first contact is bent to extend along the second direction.

5 Claims, 11 Drawing Sheets

(56) References Cited

U.S. PATENT DOCUMENTS

| | | | | |
|---|---|---|---|---|
| 6,736,676 | B2 * | 5/2004 | Zhang et al. | 439/607.22 |
| 7,018,231 | B2 * | 3/2006 | Liu et al. | 439/492 |
| 7,025,632 | B2 * | 4/2006 | Hu et al. | 439/606 |
| 7,059,872 | B2 * | 6/2006 | Tanaka et al. | 439/79 |
| 7,517,233 | B2 * | 4/2009 | Xiang | 439/79 |
| 7,625,243 | B2 | 12/2009 | Chen et al. | |
| 7,674,118 | B2 * | 3/2010 | He | 439/108 |
| 7,699,627 | B2 * | 4/2010 | Xiang et al. | 439/79 |
| 7,744,380 | B2 * | 6/2010 | Shuey et al. | 439/79 |
| 7,748,999 | B1 * | 7/2010 | Sun et al. | 439/79 |
| 7,946,893 | B2 | 5/2011 | Chen et al. | |
| 8,033,837 | B2 * | 10/2011 | Yang et al. | 439/79 |
| 8,152,569 | B2 | 4/2012 | Chen et al. | |
| 8,419,480 | B2 * | 4/2013 | Yu et al. | 439/660 |

OTHER PUBLICATIONS

Chinese Office Action (and English translation thereof) dated Mar. 10, 2015, issued in counterpart Chinese Application No. 201310218456.0.

* cited by examiner

CONNECTOR AND FORMING METHOD THEREOF

CROSS REFERENCE TO RELATED APPLICATIONS

An applicant claims priority under 35 U.S.C. §119 of Japanese Patent Application No. JP2012-133228 filed Jun. 12, 2012.

BACKGROUND OF THE INVENTION

This invention relates to a right-angle connector.

This type of connector comprises a contact which is bent so as to have a contact portion and a connection portion intersecting each other. For example, this type of connector is disclosed in U.S. Pat. No. 7,946,893 (Patent Document 1) and JP-B 2544977 (Patent Document 2), contents of which are incorporated herein by reference.

As shown in FIG. 17, the Universal Serial Bus (USB) receptacle (connector) 1000 disclosed in Patent Document 1 comprises a receptacle housing (housing) 1100, a spacer (positioner) 1200 and a plurality of receptacle contacts (contacts) 1300. Each of the contacts 1300 is bent so as to have a contact portion 1310 and a tail portion (terminal portion) 1320 perpendicular to each other. The contact portions 1310 are held by the housing 1100. The terminal portions 1320 are positioned by the positioner 1200.

As shown in FIG. 18, the connector 2000 disclosed in Patent Document 2 comprises a housing 2100, an adjustment member (positioner) 2200 and a plurality of terminals (contacts) 2300. Each of the contacts 2300 is bent so as to have a terminal end (contact portion) 2310 and a glued resilient-portion (terminal portion) 2320 gently intersecting each other. The contacts 2300 are held and positioned by the positioner 2200. Each of the housing 2100 and the positioner. 2200 is configured to be fixed to a circuit board.

When the connector of each of Patent Documents 1 and 2 is assembled, it is necessary to insert the terminal portions of the contacts into respective holes formed in the positioner. Especially, when the contacts are arranged in multiple rows like the connector of Patent Document 1, it is difficult to simultaneously bend all of the inserted contacts. Accordingly, each of the contacts should be bent before the terminal portion is inserted in the hole of the positioner. However, when each of the contacts is bent as described above, positions of ends of terminal portions tend to vary from one another. Accordingly, it is not easy to simultaneously insert the terminal portions of the contacts, which are arranged in multiple rows, into the positioner. The terminal portions of the contacts of the connector of Patent Document 2 are arranged in a single row. Accordingly, unlike the connector of Patent Document 1, it is possible to simultaneously bend all of the contacts inserted in the positioner. In other words, the terminal portions are relatively easily inserted into the positioner. However, it is necessary to attach the positioner to the circuit board separately from the housing in order to assemble the connector. As can be seen from the above description, it is time-consuming to assemble the connector of each of Patent Documents 1 and 2.

SUMMARY OF THE INVENTION

It is therefore an object of the present invention to provide a right-angle connector which is more easily assembled.

One aspect (first aspect) of the present invention provides a connector comprising a first contact, a housing and an arrangement member other than the housing. The first contact has a contact portion and a terminal portion. The housing holds the contact portion of the first contact so that the contact portion extends along a first direction. The housing is provided with an engaged portion. The arrangement member holds the terminal portion of the first contact so that the terminal portion extends along a second direction intersecting the first direction. The arrangement member is provided with an engaging portion. The engaging portion engages the engaged portion in a direction intersecting the second direction so that the arrangement member is held by the housing and the terminal portion of the first contact is bent to extend along the second direction.

Another aspect (second aspect) of the present invention provides a method of forming a connector comprising a plurality of first contacts, a housing and an arrangement member other than the housing. The method comprises a preparation step, a first holding step and a second holding step. The preparation step is a step of preparing a metal member including a plurality of metal pieces arranged in an arrangement direction. Each of the metal pieces extends in a first direction perpendicular to the arrangement direction so as to have a contact portion and a terminal portion. The first holding step is a step of holding the contact portion and the terminal portion of each of the metal pieces by the housing and the arrangement member, respectively. The second holding step is a step of bending the metal pieces held by the housing and the arrangement member so that the terminal portions extend in the second direction intersecting the first direction. The bending of the metal pieces forms the first contacts and engages the arrangement member with the housing. The engaged arrangement member is held by the housing.

An appreciation of the objectives of the present invention and a more complete understanding of its structure may be had by studying the following description of the preferred embodiment and by referring to the accompanying drawings.

Figure 1:
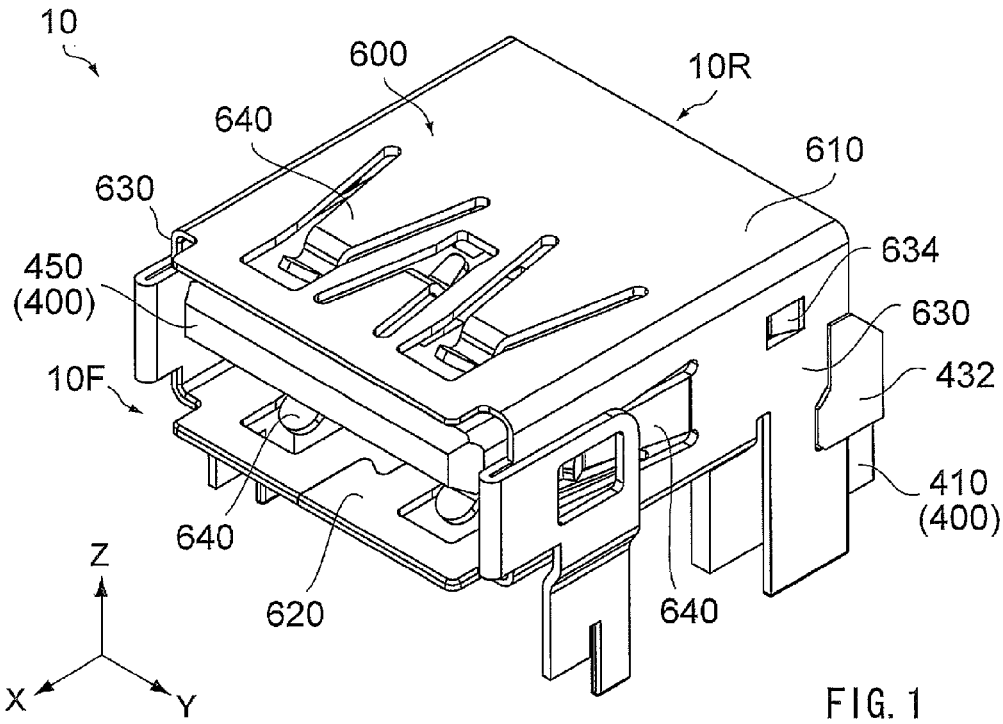
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As can be seen from FIGS. 1 to 4, a connector 10 according to an embodiment of the present invention is a right-angle connector configured to be attached to a circuit board (not shown) along the Z-direction (an up-down direction or a second direction according to the present embodiment). The connector 10 is mateable with and connectable to a mating connector (not shown) along the X-direction (a front-rear direction or a first direction according to the present embodiment). In detail, the connector 10 has a front end 10F and a rear end 10R in the X-direction. The mating connector (not shown) is insertable into the connector 10 from the front end 10F toward the rear end 10R (i.e. rearward).

As shown in FIGS. 1 to 4, the connector 10 according to the present embodiment comprises a plurality of first contacts 200 each made of a metal, a plurality of second contacts 300 each made of a metal, a housing 400 made of an insulating material, an arrangement member 500 other than the housing 400 and made of an insulating material, and a shell 600 made of a metal.

The connector 10 according to the present embodiment is compliant with a Universal Serial Bus (USB) 3.0 standard. In detail, the first contacts 200 are five contacts for USB 3.0 connection while the second contacts 300 are four contacts for USB 2.0 connection. Moreover, the housing 400 has sizes compliant with the USB 3.0 standard. However, the present invention is applicable to a connector which is not compliant with a USB standard.

Figure 2:
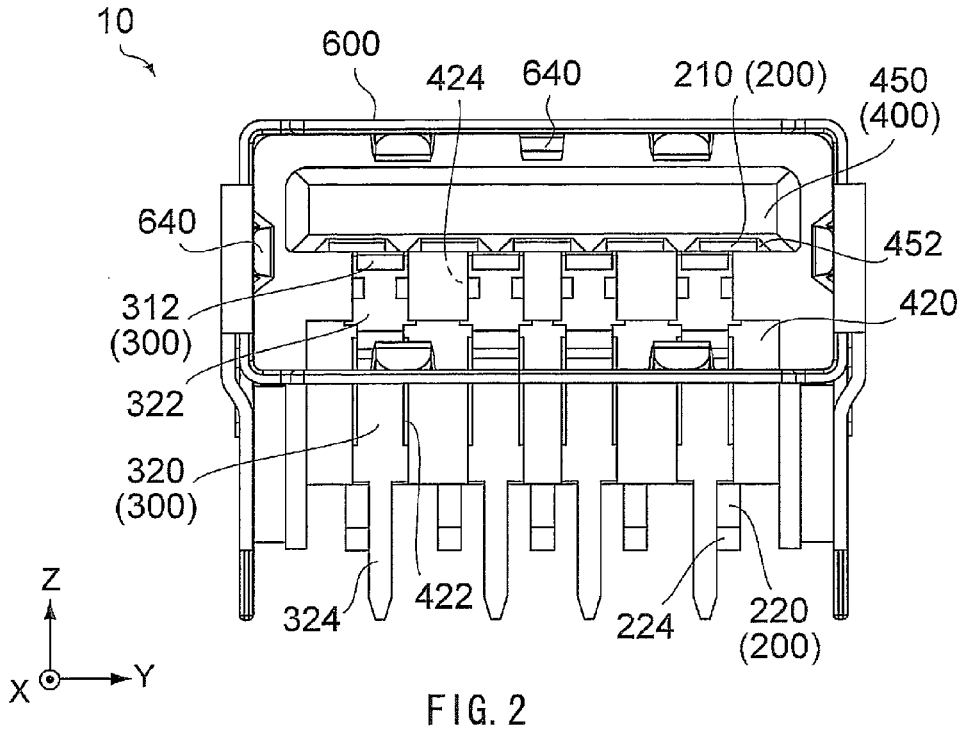
FIG. 2 is a front view showing the connector of FIG. 1.
Figure 3:
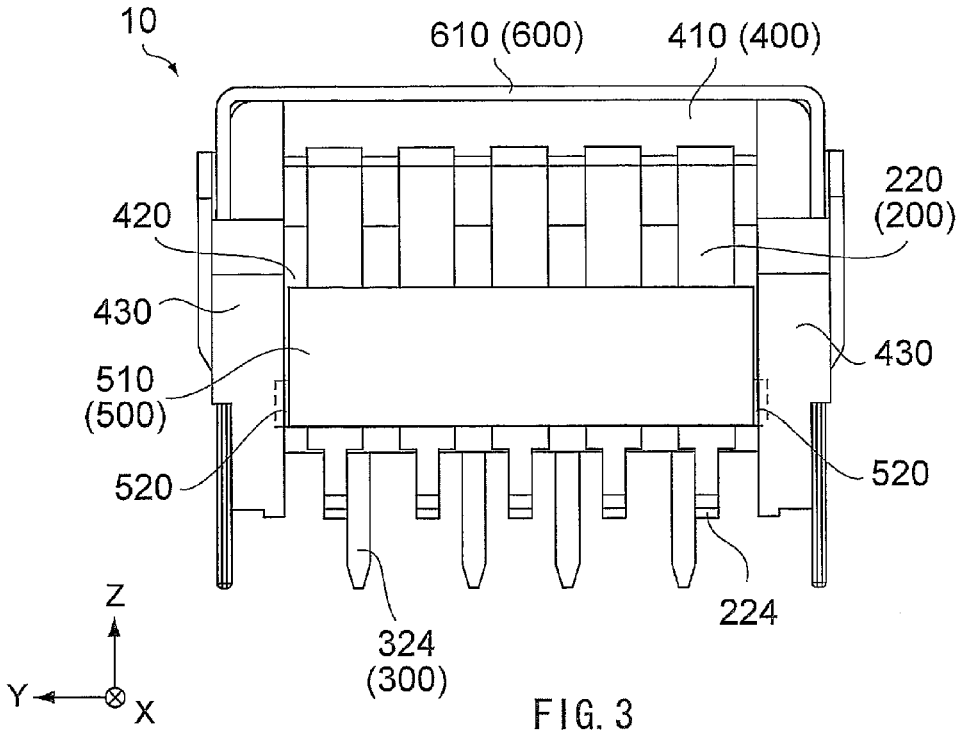
FIG. 3 is a rear view showing the connector of FIG. 1, wherein hidden parts of an arrangement member of the connector, which are hidden by a housing of the connector, is illustrated by dashed line.
Figure 4:
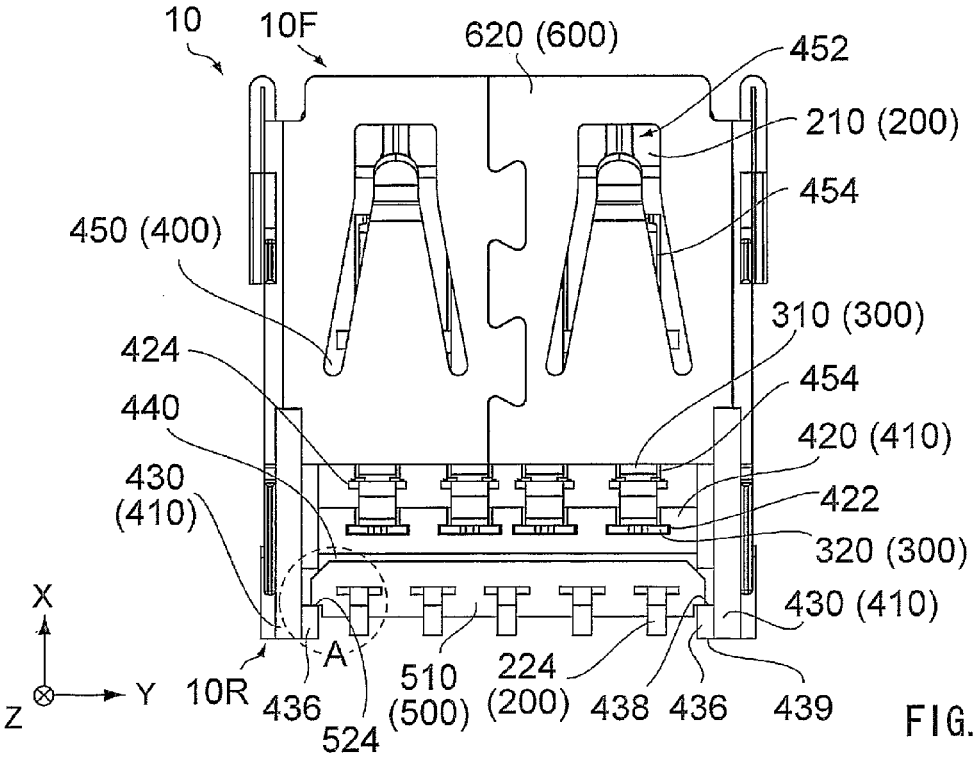
FIG. 4 is a bottom view showing the connector of FIG. 1.

As can be seen from FIGS. 2 to 4, each of the first contacts 200 has a contact portion 210 and a terminal portion 220. The contact portion 210 extends in the first direction while the terminal portion 220 extends in the second direction. More specifically, according to the present embodiment, the contact portion 210 extends in the X-direction while the terminal portion 220 extends in the Z-direction. The contact portion 210 is electrically connected to a first mating contact (not shown) of the mating connector (not shown) under a mated state where the connector 10 and the mating connector are mated with each other. The terminal portion 220 is electrically connected to a circuit (not shown) of the circuit board (not shown) when the connector 10 is mounted on the circuit board. In detail, a lower end (i.e. the negative Z-side end) of the terminal portion 220 is bent to extend in the negative X-direction so that the terminal portion 220 is formed with a connection portion 224. The connection portion 224 is configured to be connected and fixed to the circuit of the circuit board, for example, by soldering.

Figure 11:
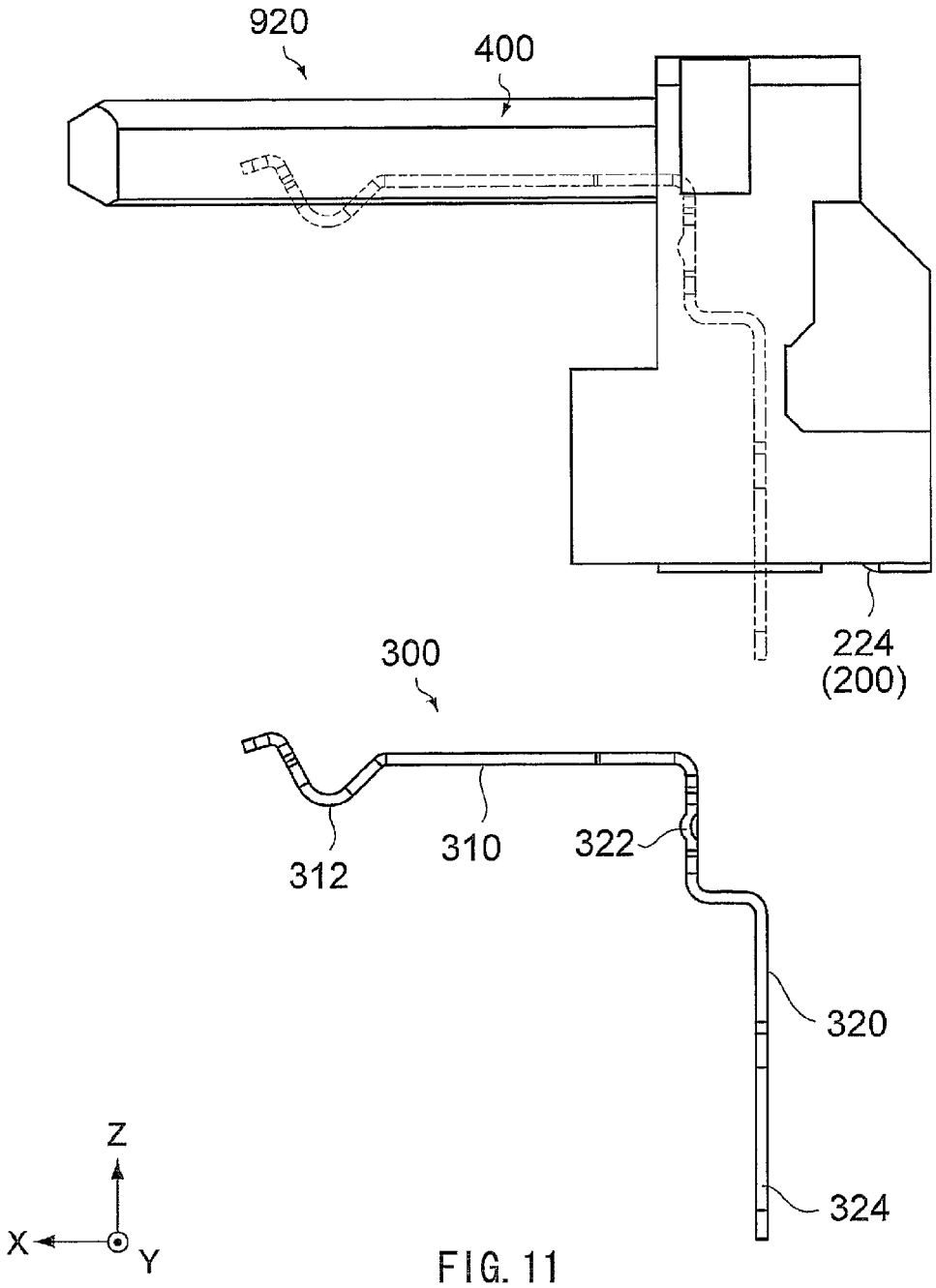
FIG. 11 is a side view showing a second intermediary body formed by bending the metal pieces of the first intermediary body member of FIG. 10, and a second contact configured to be attached to the second intermediary body, wherein the second contact attached to the second intermediary body is illustrated by two-dot chain line.
Figure 12:
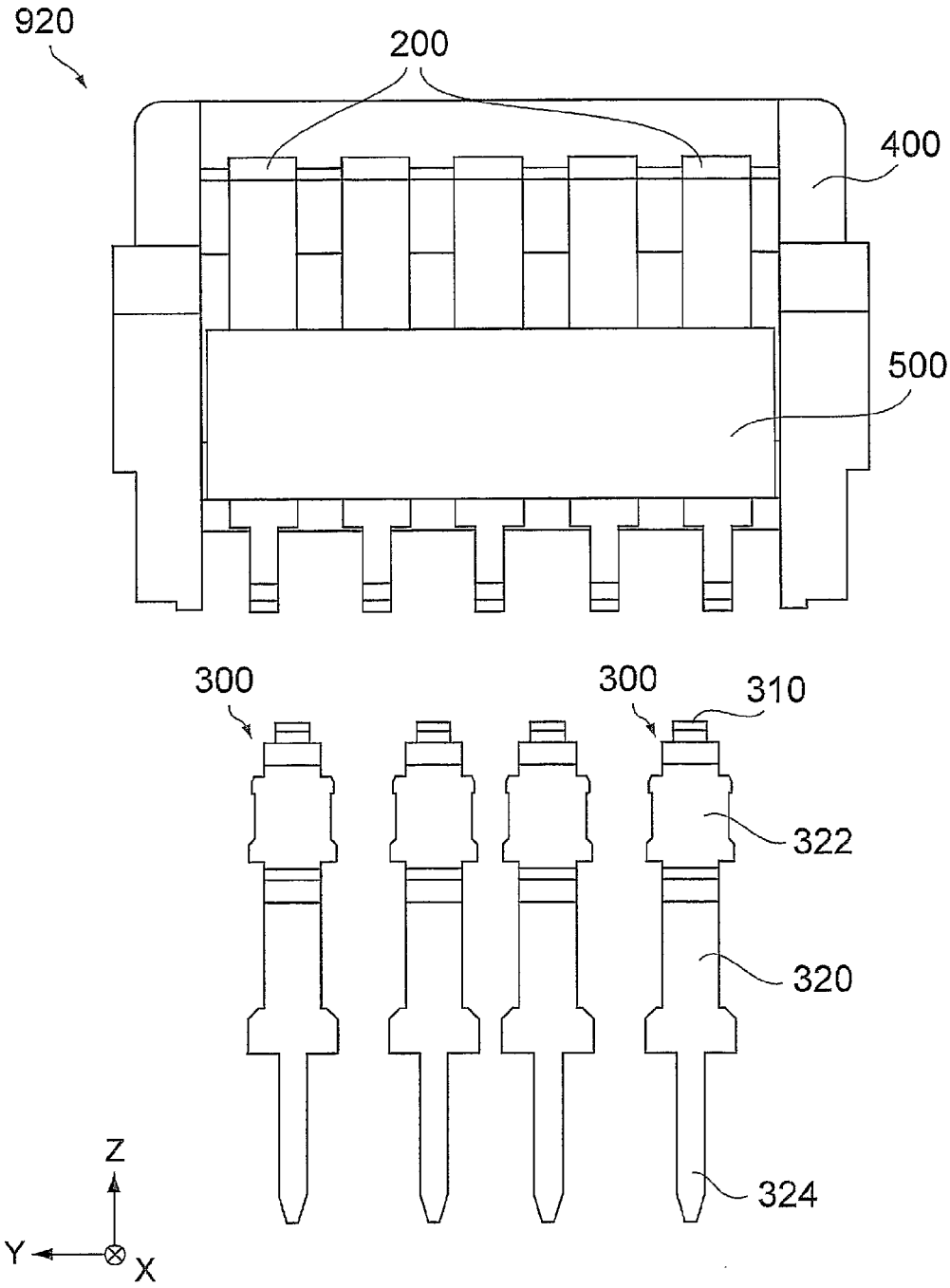
FIG. 12 is a rear view showing the second intermediary body and the second contacts of FIG. 11.

As shown in FIGS. 11 and 12, each of the second contacts 300 has a contact portion 310 extending in the X-direction and a terminal portion 320 extending in the Z-direction. The contact portion 310 has a contact-point 312 which curves downward (i.e. in the negative Z-direction). The contact-point 312 is electrically connected to a second mating contact (not shown) of the mating connector (not shown) under the mated state. The terminal portion 320 has a press-fitted portion 322 and a connection portion 324. The press-fitted portion 322 is press-fitted in and held by the housing 400. The connection portion 324 is connected and fixed to the circuit (not shown) of the circuit board (not shown), for example, by soldering when the connector 10 is mounted on the circuit board.

Figure 13:
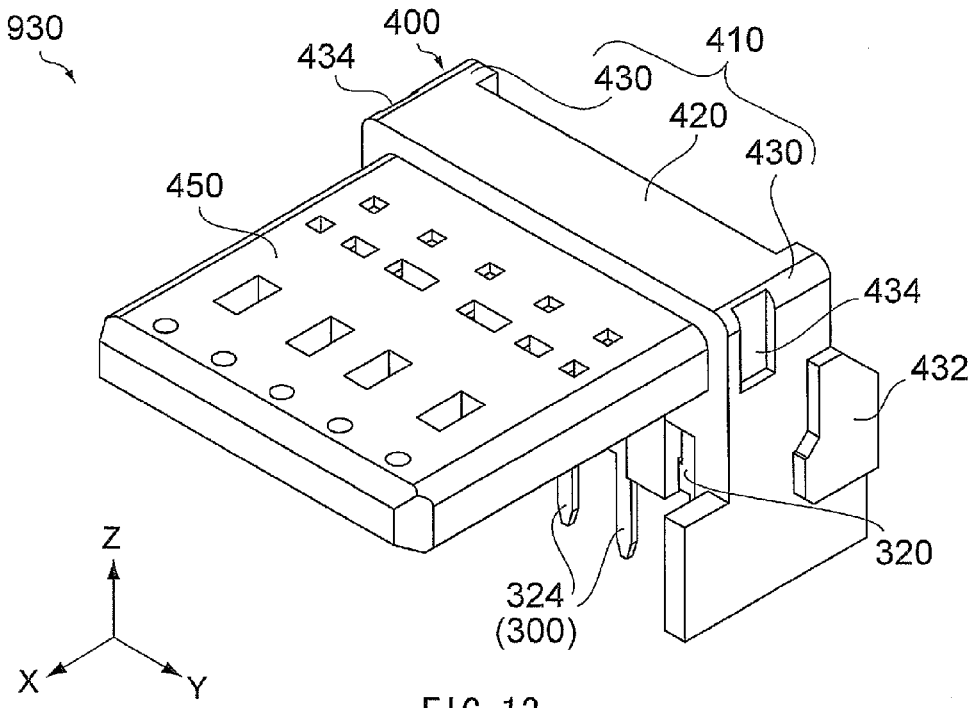
FIG. 13 is a perspective view showing a third intermediary body formed by attaching the second contacts to the second intermediary body of FIG. 11.
Figure 14:
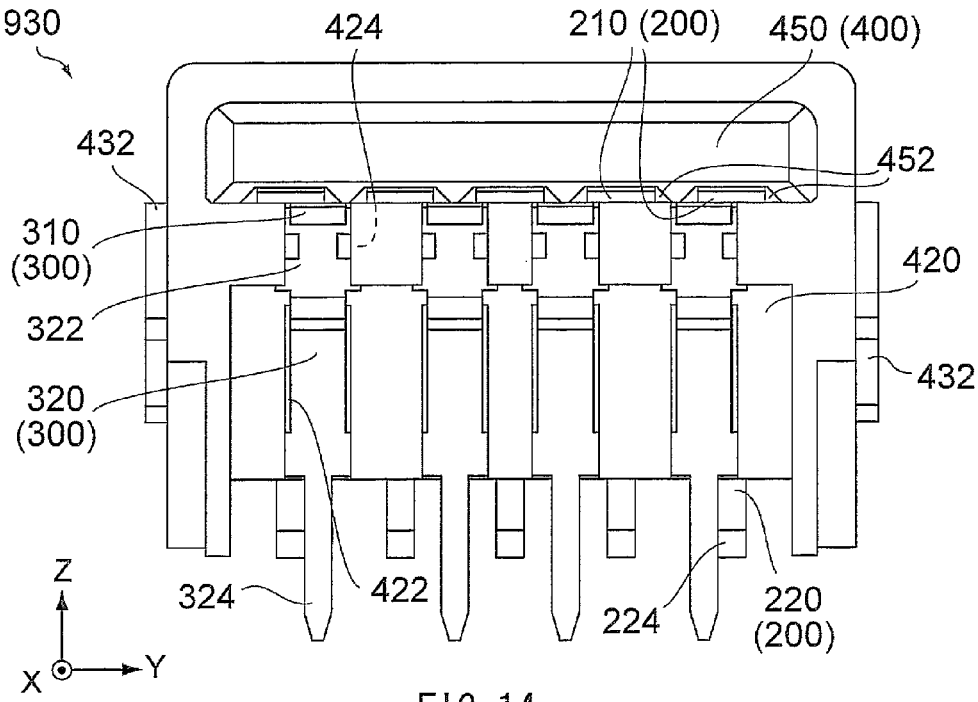
FIG. 14 is a front view showing the third intermediary body of FIG. 13.
Figure 15:
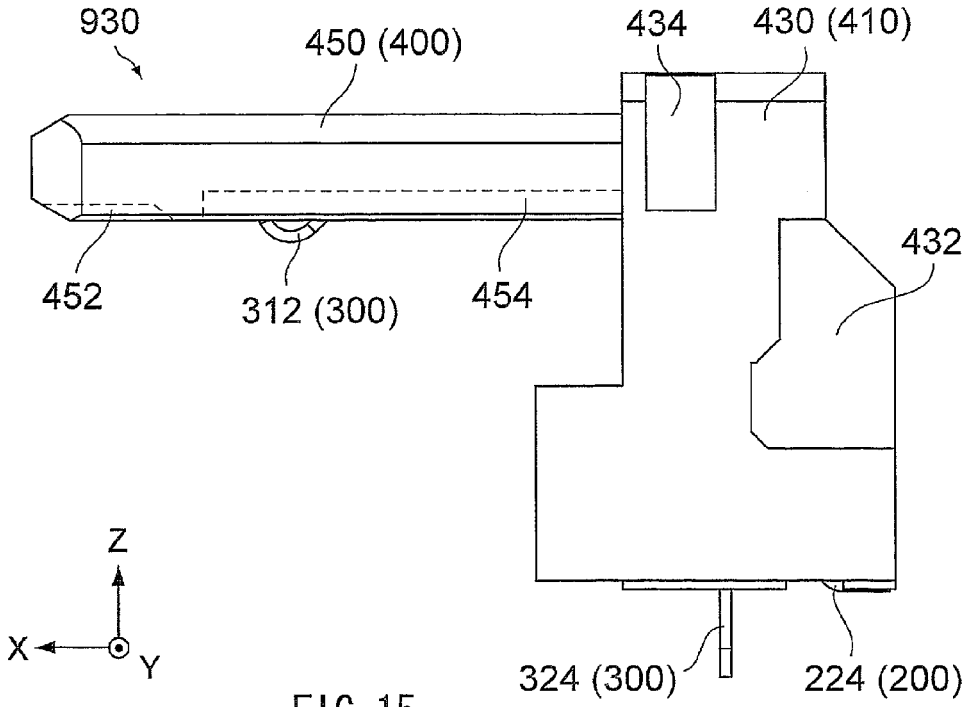
FIG. 15 is a side view showing the third intermediary body of FIG. 13, wherein outlines of a recess and a holding ditch each formed in the housing are schematically illustrated by dashed line.

As shown in FIGS. 13 to 15, the housing 400 has a body portion 410 and a plate-like portion 450. The body portion 410 protrudes in the positive Z-direction (i.e. upward) while extending long in the Y-direction (width direction). The plate-like portion 450 has a rectangular plate-like shape protruding forward (i.e. along the positive X-direction) from the vicinity of an upper end (i.e. the positive Z-side end) of the body portion 410.

As can be seen from FIGS. 4, 14 and 15, the plate-like portion 450 has a lower surface (i.e. the negative Z-side surface) which is formed with recesses 452 each recessed upward and holding ditches 454 each recessed upward.

According to the present embodiment, the five recesses 452 are arranged in the vicinity of a front end (i.e. the positive X-side end) of the plate-like portion 450 so as to correspond to the first contacts 200, respectively. The five recesses 452 are provided at the same position in the X-direction. The housing 400 holds the contact portions 210 of the first contacts 200 in the plate-like portion 450 so that the contact portions 210 extend along the X-direction (first direction). Each of the contact portions 210 has an end exposed within the recess 452.

As can be seen from FIGS. 4 and 15, according to the present embodiment, the four holding ditches 454 are provided so as to correspond to the second contacts 300, respectively. Each of the holding ditches 454 extends along the positive X-direction from the vicinity of a rear end (i.e. negative X-side end) of the plate-like portion 450 to the rear of the recess 452. In other words, the holding ditches 454 are located rearward of the recesses 452 in the X-direction. The contact portions 310 of the second contacts 300 are held by the holding ditches 454 of the housing 400, respectively, so as to extend in parallel to the contact portion 210 of the first contact 200. The contact-point 312 of each of the second contacts 300 protrudes downward from the lower surface of the plate-like portion 450.

As shown in FIGS. 13 to 15, the body portion 410 of the housing 400 has a holding portion 420 and two side portions 430. The side portions 430 are formed at opposite ends of the body portion 410 in the Y-direction, respectively. In other words, the holding portion 420 is located between the two side portions 430 in the Y-direction.

As shown in FIGS. 3 and 4, the holding portion 420 is located forward of a rear end of the side portion 430 so that the body portion 410 has a receive portion 440 formed rearward of the holding portion 420. In other words, the receive portion 440 according to the present embodiment is a space surrounded by the holding portion 420 and the two side portions 430. The receive portion 440 receives the arrangement member 500.

Figure 6:
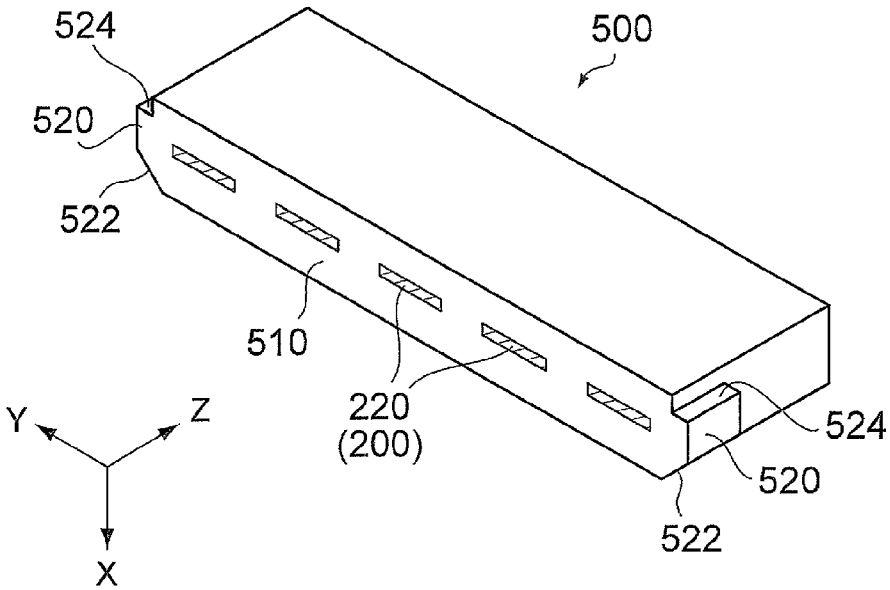
FIG. 6 is a perspective view showing the arrangement member of FIG. 4.
Figure 7:
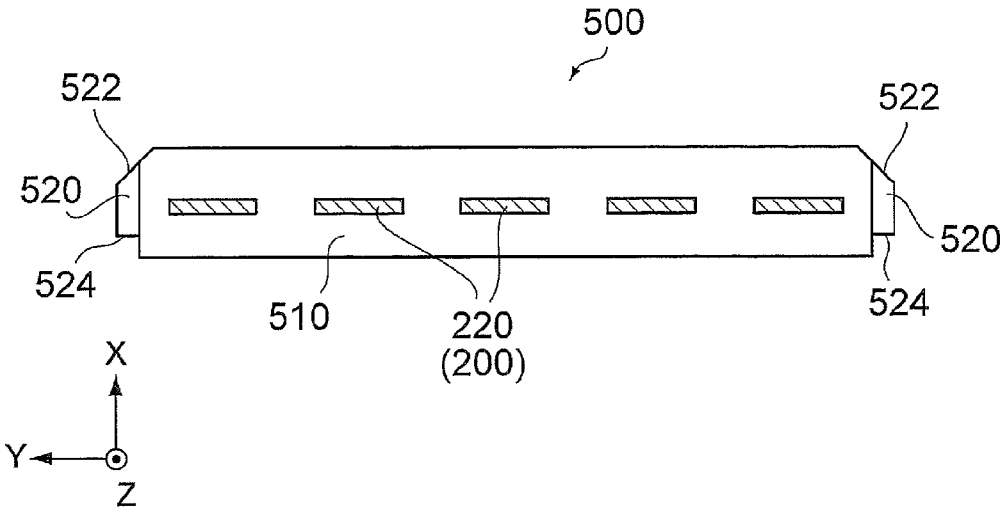
FIG. 7 is atop view showing the arrangement member of FIG. 6.

As shown in FIGS. 4, 6 and 7, the arrangement member 500 according to the present embodiment has a plate-like shape extending long in the Y-direction. In detail, the arrangement member 500 is composed of a contact-holding portion 510 having a rectangular plate-like shape and two protrusions 520. The protrusions 520 are formed at opposite ends of the contact-holding portion 510 in the Y-direction, respectively.

The contact-holding portion 510 arranges and holds the terminal portions 220 of the five first contacts 200 (i.e. arranges and holds the first contacts 200) so that the terminal portions 220 are arranged in a single row along the Y-direction. In other words, the terminal portions 220 are fixed to the arrangement member 500. Accordingly, the terminal portions 220 are positioned relative to the housing 400 by positioning the arrangement member 500 relative to the housing 400.

The arrangement member 500 is provided with two abutment portions 522 and two engaging portions 524. In detail, each of the protrusions 520 protrudes outward in the Y-direction from the contact-holding portion 510 so that the protrusion 520 is formed with the engaging portion 524 at a rear end thereof. The engaging portion 524 according to the present embodiment is a plane perpendicular to the X-direction. Each of the protrusions 520 has a front end. The front end of the protrusion 520 is chamfered together with a front end of the contact-holding portion 510 so that the arrangement member 500 is formed with the abutment portion 522. The abutment portion 522 according to the present embodiment is a plane oblique to both the X-direction and the Y-direction. The abutment portions 522 are provided as described above so that a width (i.e. a size in the Y-direction) of a front end of the arrangement member 500 is smaller than a width of a rear end of the arrangement member 500.

Figure 5:
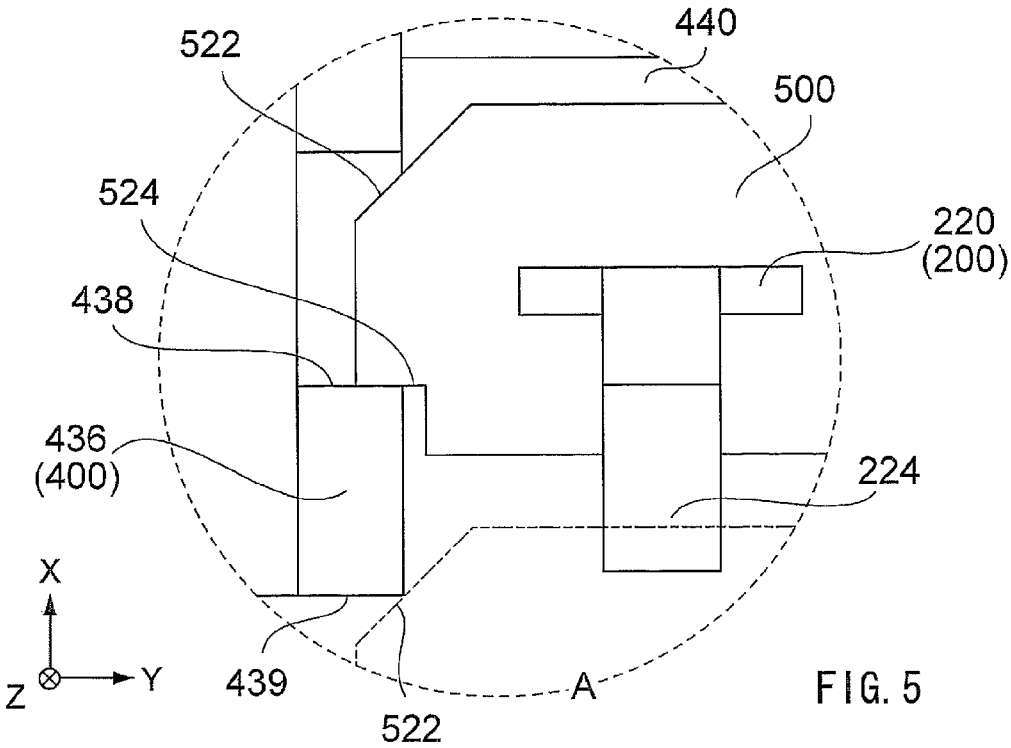
FIG. 5 is a partially enlarged, bottom view showing about an engaging portion of the arrangement member and a lock portion of the housing (a part enclosed by dashed line A) of FIG. 4, wherein an outline of the arrangement member, which is located at a position where an abutment portion of the arrangement member is brought into contact with the lock portion, is illustrated by two-dot-chain line.

As can be seen from FIGS. 3 to 5, a facing side of each of the side portions 430, which faces the receive portion 440, is partially cut so that each of the side portions 430 is formed with a lock portion 436. Each of the lock portions 436 protrudes toward the inside of the receive portion 440 from the side portion 430 so that the lock portion 436 (i.e. the housing 400) is provided with an engaged portion 438 and an abutment portion 439. Each of the engaged portion 438 and the abutment portion 439 according to the present embodiment is a plane perpendicular to the X-direction.

As can be seen from FIGS. 2 to 5 and 10, the arrangement member 500 is inserted and received in the receive portion 440 from the outside of the housing 400. In detail, the five first contacts 200 are held by the arrangement member 500 so as to be located at the same position in the XZ-plane (see FIGS. 6 and 7). Accordingly, the first contacts 200 are bendable along a direction parallel to the XZ-plane without being twisted. In other words, it is possible to bend the first contacts 200 in such a manner that the arrangement member 500 rotates about an axis which is in parallel to the Y-direction. According to the present embodiment, the first contacts 200 are bent in such a manner that the terminal portions 220 extend along the Z-direction so that the arrangement member 500 is inserted in the receive portion 440. Under a state where the arrangement member 500 is received in the receive portion 440, the arrangement member 500 arranges and holds the first contacts 200 in a direction perpendicular to a plane (according to the present embodiment, the XZ-plane) defined by the first direction (i.e. an extending direction of the contact portion 210) and the second direction (i.e. an extending direction of the terminal portion 220).

As can be seen from FIGS. 3 to 5, the engaging portions 524 are engaged with the engaged portions 438 in the X-direction (i.e. a direction perpendicular to the second direction), respectively. In detail, the arrangement member 500 receives a restoring force from the terminal portions 220 which are bent. According to the present embodiment, the arrangement member 500 receives the restoring force along the negative X-direction so that the engaging portions 524 are pressed against the engaged portions 438, respectively. Thus, the engaging portions 524 engage the engaged portions 438, respectively, so that the arrangement member 500 is held by the housing 400 and positioned in the X-direction. Meanwhile, the arrangement member 500 is sandwiched between the two lock portions 436 so that the arrangement member 500 is also positioned in the Y-direction.

According to the present embodiment, the engaging portion 524 formed in a planar shape is in surface-to-surface contact with the engaged portion 438 formed in a planar shape so that the engaging portion 524 and the engaged portion 438 are more securely engaged with each other. In other words, the arrangement member 500 is more securely positioned. However, the engaging portion 524 and the engaged portion 438 may not be in surface-to-surface contact. For example, the engaging portion 524 or the engaged portion 438 may be formed in a surface having irregularities.

According to the present embodiment, the extending direction (i.e. the second direction) of the terminal portion 220 is perpendicular to the extending direction (i.e. the first direction) of the contact portion 210. Moreover, the engaging portion 524 and the engaged portion 438 are engaged with each other in a direction perpendicular to the second direction. However, it is sufficient that the second direction intersects the first direction. Moreover, it is sufficient that the engaging portion 524 and the engaged portion 438 are engaged with each other in a direction intersecting the second direction. In other words, the engaging portion 524 may engage the engaged portion 438 in a direction intersecting the second direction so that the arrangement member 500 may be held by the housing 400 and the terminal portion 220 of the first contact 200 may be bent to extend along the second direction.

Figure 8:
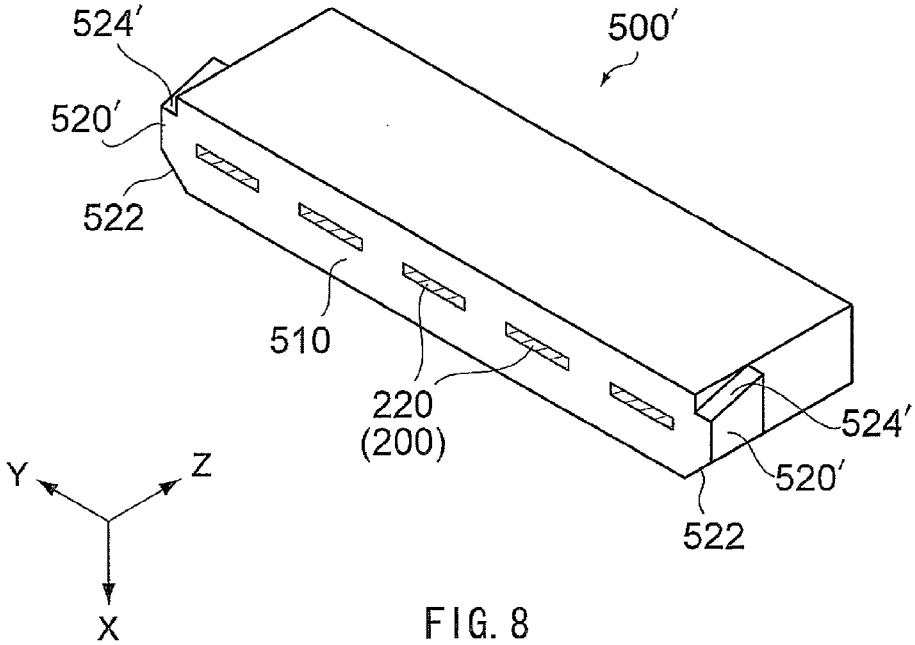
FIG. 8 is a perspective view showing a modification of the arrangement member of FIG. 6.

As can be seen from FIGS. 4 and 8, for example, not the arrangement member 500 but an arrangement member 500' may be held by the housing 400. The arrangement member 500' has the contact-holding portion 510 similar to the arrangement member 500 while having protrusions 520' which are a little different from the protrusions 520. More specifically, each of the protrusions 520' is formed with the abutment portion 522 and an engaging portion 524'. Unlike the engaging portion 524, the engaging portion 524' is a plane oblique to both the X-direction and the Z-direction.

Figure 10:
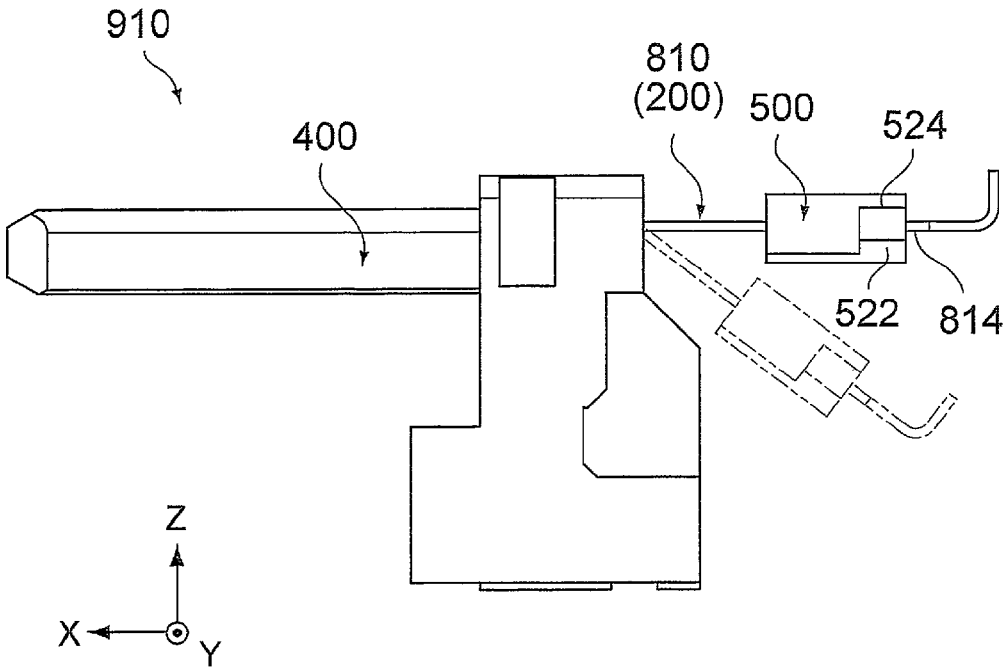
FIG. 10 is a side view showing a first intermediary body comprising the housing and the arrangement member of FIG. 4, and the metal pieces held by the housing and the arrangement member, wherein the arrangement member and the metal pieces, which are in a state where the metal pieces are half bent, are illustrated by two-dot chain line.

As can be seen from FIGS. 5, 8 and 10, under a state where the arrangement member 500' is received in the receive portion 440, the terminal portions 220 extend obliquely downward. In detail, the terminal portions 220 extend along the second direction oblique to the first direction along which the contact portions 210 extend. Meanwhile, the engaging portion 524' and the engaged portion 438 are engaged with each other in the X-direction. In other words, the engaging portion 524' and the engaged portion 438 are engaged with each other in a direction oblique to a direction (i.e. second direction) along which the terminal portion 220 extends.

The housing 400 may be provided with modified engaged portions (not shown), each is a modification of the engaged portion 438, instead of forming the engaging portions 524' each is oblique to the X-direction. More specifically, each of the modified engaged portions may be shaped in a planar shape oblique to both the X-direction and the Z-direction. In this case, under a state where the arrangement member 500 is received in the receive portion 440, the terminal portions 220 extend obliquely downward (i.e. extend in the second direction). Meanwhile, the engaging portion 524 and the modified engaged portion are engaged with each other in a direction perpendicular to the second direction. In other words, the engaging portion 524 and the modified engaged portion are engaged with each other in a direction oblique to a direction (i.e. first direction) along which the contact portion 210 extends.

As shown in FIG. 5, when the arrangement member 500 is inserted into the receive portion 440, each of the abutment portions 522 is brought into abutment with an edge of the abutment portion 439. If the arrangement member 500 is kept to be pressed in the positive X-direction, the lock portions 436 are pushed outward in the Y-direction to be resiliently deformed so that the arrangement member 500 is received in the receive portion 440. The abutment portion 522 and the abutment portion 439 may be formed differently from the present embodiment, provided that the lock portions 436 are configured to open outward in the Y-direction. For example, the abutment portion 522 may be shaped in a planar shape perpendicular to the X-direction and the abutment portion 439 may be shaped in a planar shape oblique to both the X-direction and the Y-direction. More specifically, the abutment portion 439 may be chamfered. Moreover, each of the abutment portion 522 and the abutment portion 439 may be chamfered.

As shown in FIGS. 2, 4 and 14, the holding portion 420 has a front-end surface formed with four guide ditches 422 corresponding to the second contacts 300, respectively, and four press-fit portions 424 corresponding to the guide ditches 422, respectively. Each of the guide ditches 422 is a ditch recessed rearward. The guide ditch 422 extends in the Z-direction on the front-end surface of the holding portion 420. Each of the press-fit portions 424 is provided about an upper end of the guide ditch 422.

As can be seen from FIGS. 2, 4, 11 and 14, the terminal portion 320 of the second contact 300 is guided upward (along the positive Z-direction) by the guide ditch 422 to be attached to the housing 400. When the second contact 300 is attached to the housing 400, the press-fitted portion 322 is press-fitted into the press-fit portion 424. Accordingly, the terminal portion 320 of the second contact 300 is held by the holding portion 420 of the housing 400 so as to extend in parallel to the terminal portion 220 of the first contact 200.

As shown in FIGS. 13 to 15, each of the side portions 430 is further formed with a bulge 432 and a depression 434. The bulge 432 and the depression 434 are formed on an outside surface of the side portion 430 in the Y-direction. The bulge 432 protrudes outward in the Y-direction while the depression 434 is depressed inward in the Y-direction.

Figure 16:
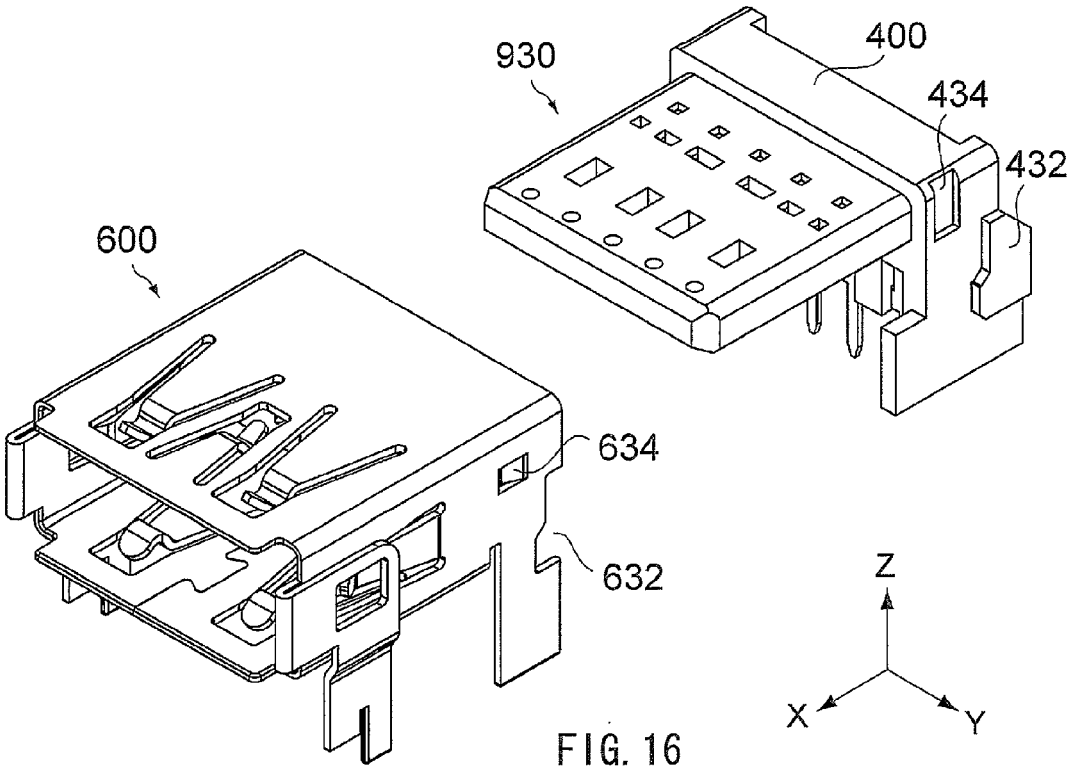
FIG. 16 is a perspective view showing the third intermediary body of FIG. 13 and a shell configured to be attached to the third intermediary body.
Figure 17:
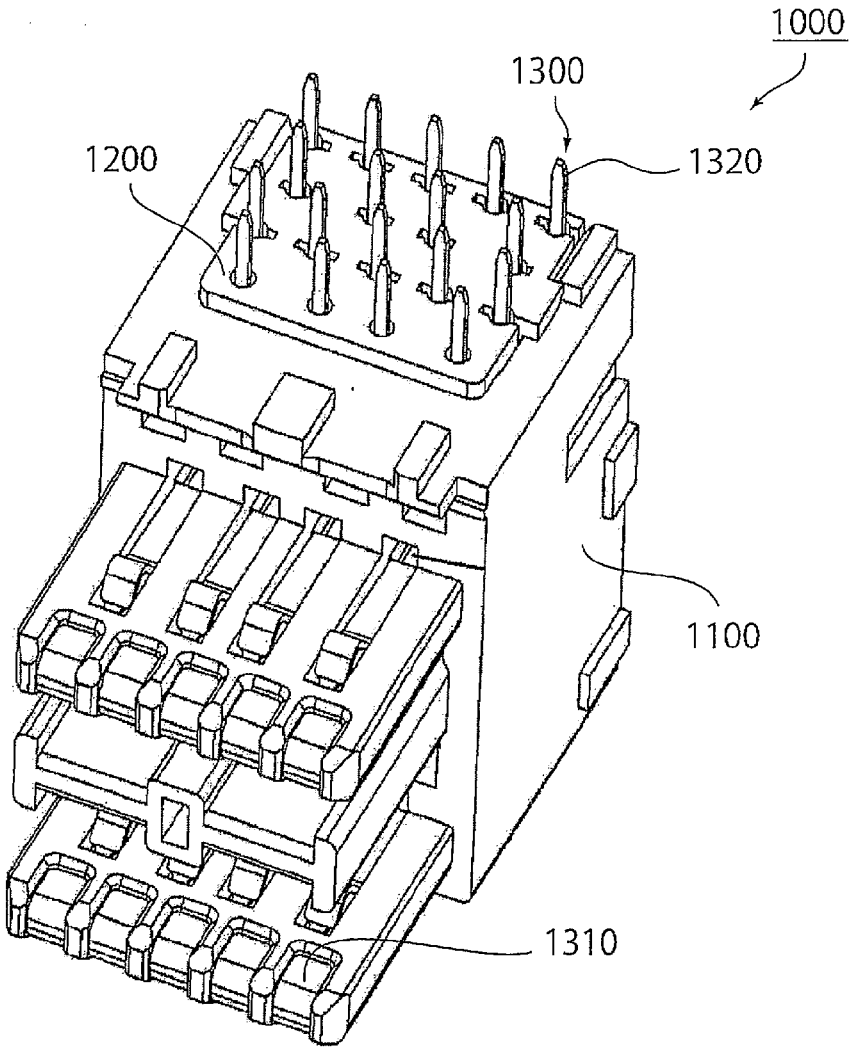
FIG. 17 PRIOR ART
FIG. 17 is a perspective view showing an existing connector.
Figure 18:
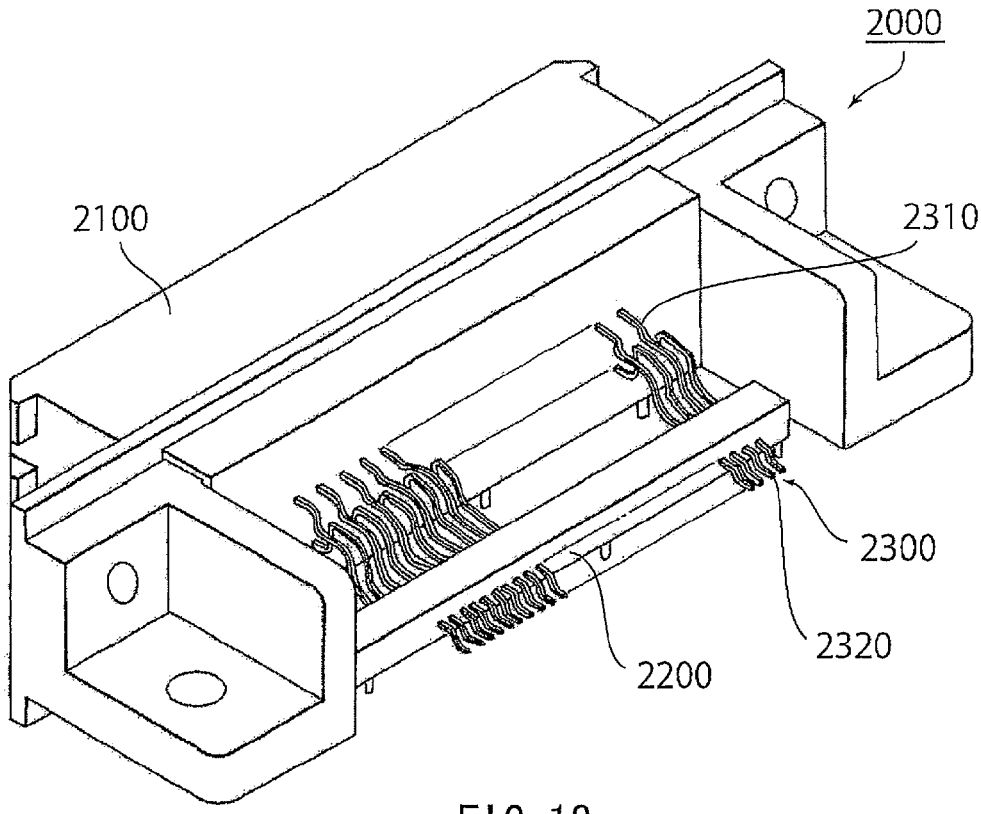
FIG. 18 PRIOR ART
FIG. 18 is a perspective view showing another existing connector.

As can be seen from FIGS. 1 and 16, the shell 600 according to the present embodiment is formed by punching and bending a single metal plate. In detail, the shell 600 is formed to have a low-height, rectangular tube-like shape which is composed of an upper plate 610, a bottom plate 620 and two side plates 630. The shell 600 has a joint on the bottom plate 620. The shell 600 is attached to the housing 400 so as to cover the most of the housing 400.

Each of the side plates 630 is formed with a notch 632 and a fixing portion 634. The notch 632 is formed about a rear end of the side plate 630. The fixing portion 634 extends inward in the Y-direction. The fixing portion 634 is supported by the side plate 630 so as to be resiliently deformable.

As shown in FIGS. 1 and 2, each of the upper plate 610, the bottom plate 620 and the side plates 630 is formed with one or more shell-connection portions 640. Each of the shell-connection portions 640 is formed by cutting a part of the shell 600 so that the cut part extends in the X-direction. The shell-connection portion 640 has an end which curves toward the inside of the shell 600. The end of the shell-connection portion 640 is resiliently supported so as to be movable toward the outside of the shell 600. When the mating connector (not shown) is inserted in the connector 10, the shell-connection portions 640 are electrically connected to a mating shell (not shown) of the mating connector.

Hereinafter, it is described about a method (i.e. forming method) of forming or assembling the connector 10 configured as described above. The forming method of the connector 10 comprises a preparation step, a first holding step, a second holding step, a third holding step and a shielding step. However, if the connector 10 does not comprise the second contacts 300, the forming method may not comprise the third holding step. Moreover, if the connector 10 does not comprise the shell 600, the forming method may not comprise the shielding step.

Figure 9:
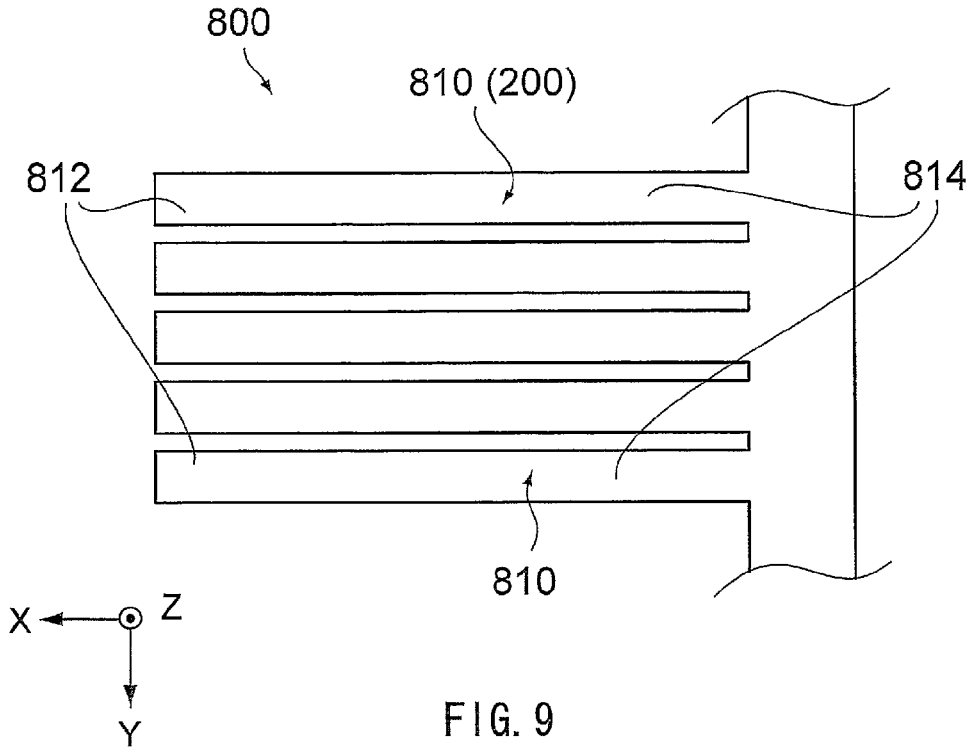
FIG. 9 is a schematic, top view showing a metal member including metal pieces from which first contacts of the connector of FIG. 4 are formed.

As shown in FIG. 9, a metal member 800 is prepared in the preparation step by punching a metal plate. The metal member 800 according to the present embodiment includes five (i.e. a plurality of) metal pieces 810 which constitute the first contacts 200, respectively. The metal pieces 810 are arranged in an arrangement direction (Y-direction). Each of the metal pieces 810 extends in the first direction (X-direction) perpendicular to the arrangement direction so as to have a contact portion 812 and a terminal portion 814.

Then, as can be seen from FIG. 10, in the first holding step, the opposite ends in the X-direction of each of the metal pieces 810 is held by the housing 400 and the arrangement member 500, respectively, so that a first intermediary body 910 is formed.

More specifically, the contact portion 812 and the terminal portion 814 of each of the metal pieces 810 are held by the housing 400 and the arrangement member 500, respectively. According to the present embodiment, the metal pieces 810 are insert-molded in the housing 400 and the arrangement member 500 in the first holding step so that the housing 400 and the arrangement member 500 are simultaneously formed by a common metal mold (not shown). In other words, the first contacts 200 according to the present embodiment are insert-molded in the housing 400 and the arrangement member 500.

It is possible to hold the metal pieces 810 in the first holding step by another method which is different from the method of the present embodiment. For example, the housing 400 and the arrangement member 500 may be formed separately by different methods from each other. Moreover, the contact portion 812 and the terminal portion 814 of the metal piece 810 may be press-fitted in the housing 400 and the arrangement member 500, respectively. However, it is preferred to form the first intermediary body 910 similar to the present embodiment in order to hold the metal pieces 810 more easily.

Then, as can be seen from FIGS. 10 and 11, in the second holding step, the arrangement member 500 is held by the housing 400 so that a second intermediary body 920 is formed. In detail, the metal pieces 810 held by the housing 400 and the arrangement member 500 are bent so that the terminal portions 814 extend in the Z-direction (i.e. the second direction intersecting the first direction). The bending of the metal pieces 810 forms the first contacts 200 and engages the arrangement member 500 with the housing 400. The arrangement member 500, which is thus engaged, is held by the housing 400.

Then, as can be seen from FIGS. 11 to 15, in the third holding step, the second contacts 300 are held by the housing 400 so that a third intermediary body 930 is formed. Each of the second contacts 300 is formable by punching and bending a metal plate similar to the first contact 200.

Then, as can be seen from FIGS. 1 and 16, in the shielding step, the shell 600 is attached to the third intermediary body 930 so that the connector 10 is formed. In detail, when the third intermediary body 930 is inserted into the shell 600 along the positive X-direction, the bulges 432 engaged with the notches 632, respectively, so that the shell 600 is positioned at a proper position. Meanwhile, ends of the fixing portions 634 are inserted into the depressions 434, respectively, so that the shell 600 is fixed to the housing 400.

As can be seen from the above description, according to the present embodiment, the metal pieces 810 (the first contacts 200) are arranged at proper positions, respectively, at the same time that the housing 400 and the arrangement member 500 are formed. Moreover, by a simple operation of inserting the arrangement member 500 into the receive portion 440 of the housing 400, the metal pieces 810 (the first contacts 200) are bent so that the first contacts 200 are completely positioned. In other words, before the first contacts 200 are bent, the contact portion 210 and the terminal portion 220 of each of the first contacts 200 are held by the housing 400 and the arrangement member 500, respectively. Accordingly, the connector 10 may be more easily assembled.

The connector 10 according to the present embodiment can be modified variously. For example, an arrangement member may be provided for each of the first contacts 200. More specifically, a plurality of the arrangement member may be formed so as to hold the first contacts 200, respectively. In this case, the housing 400 may be provided with a plurality of receive portions correspond to the arrangement members, respectively, and a plurality of lock portions correspond to the receive portions, respectively.

According to the present embodiment, the terminal portion 220 of the first contact 200 is bent by inserting the arrangement member 500 into the receive portion 440 of the housing 400. However, the terminal portion 220 may be bent differently. For example, before the arrangement member 500 is inserted in the receive portion 440, the terminal portions 220 may be slightly bent at the same position by using a tool (not shown). In this case, the terminal portions 220 are completely bent by inserting the arrangement member 500 into the receive portion 440 and engaging the arrangement member 500 with the receive portion 440.

The present application is based on a Japanese patent application of JP2012-133228 filed before the Japan Patent Office on Jun. 12, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a plurality of first contacts each having a contact portion and a terminal portion;

a single housing holding the contact portions of the plurality of first contacts so that the contact portions extend along a first direction which is a front-rear direction of the connector, the housing being provided with an engaged portion; and a single arrangement member other than the housing, the arrangement member holding the terminal portions of the plurality of first contacts so that the terminal portions extend along a second direction intersecting the first direction, the arrangement member being provided with an engaging portion, and the engaging portion engaging the engaged portion in a direction intersecting the second direction so that the arrangement member is held by the housing and the terminal portions of the plurality of first contacts are bent to extend along the second direction, wherein the arrangement member arranges and holds the plurality of first contacts in a width direction perpendicular to a plane defined by the first direction and the second direction, wherein the engaging portion is in contact with the engaged portion along a direction perpendicular to both the second direction and the width direction, wherein the contact portions of the plurality of first contacts are located forward of the terminal portions of the plurality of first contacts in the first direction, wherein at least a part of the engaging portion is located on a front surface of the engaged portion in the first direction, and wherein the plurality of first contacts are insert-molded in the single housing and the single arrangement member.

2. The connector as recited in claim 1, wherein the engaging portion is in surface-to-surface contact with the engaged portion.

3. The connector as recited in claim 1, wherein the second direction is perpendicular to the first direction.

4. The connector as recited in claim 1, the connector further comprising a second contact, wherein:

the second contact has a second contact portion and a second terminal portion;

the second contact portion is held by the housing so as to extend in parallel to the contact portions of the plurality of first contacts; and the second terminal portion is held by the housing so as to extend in parallel to the terminal portions of the plurality of first contacts.

5. The connector as recited in claim 1, wherein the connector is compliant with a Universal Serial Bus (USB) 3.0 standard.

* * * * *